US005241487A

United States Patent [19]

Bianco

[11] Patent Number: 5,241,487

[45] Date of Patent: Aug. 31, 1993

[54] RACECAR TIMING AND TRACK CONDITION ALERT SYSTEM AND METHOD

[76] Inventor: James S. Bianco, 217 Brainard Rd., Enfield, Conn. 06082

[21] Appl. No.: 593,348

[22] Filed: Oct. 3, 1990

Related U.S. Application Data

[63] Continuation-in-part of Ser. No. 573,912, Aug. 28, 1990, abandoned.

[51] Int. Cl.[5] ..... G04F 8/08; G08B 1/08

[52] U.S. Cl. ..... 364/569; 340/323 R; 368/6

[58] Field of Search ..... 364/569, 561, 410, 565; 180/168; 340/323 R; 273/86 R, 86 B; 368/1, 6, 8, 9; 358/108

[56] References Cited

U.S. PATENT DOCUMENTS

| | | | |
|---|---|---|---|
| 3,610,895 | 10/1971 | Wollesen | 377/20 |
| 3,795,907 | 3/1974 | Edwards | 340/323 R |
| 4,074,117 | 2/1978 | DeLorean et al. | 340/323 R |
| 4,349,196 | 9/1982 | Smith, III et al. | 273/86 B |
| 4,449,114 | 5/1984 | Fascenda et al. | 364/410 |
| 4,451,896 | 5/1984 | Pomerleau et al. | 364/569 |
| 4,539,650 | 9/1985 | Griffin et al. | 364/567 |
| 4,571,698 | 2/1986 | Armstrong | 364/569 |
| 4,698,781 | 10/1987 | Cockerell, Jr. | 364/561 |
| 4,747,064 | 5/1988 | Johnston | 364/569 |
| 4,752,764 | 6/1988 | Peterson et al. | 340/323 R |
| 4,785,282 | 11/1988 | Martell et al. | 273/86 R X |
| 4,857,886 | 8/1989 | Crews | 340/323 R |
| 5,029,294 | 7/1991 | Kim | 180/168 X |
| 5,068,795 | 11/1991 | Kamimura et al. | 364/449 |
| 5,138,589 | 8/1992 | Kimbel | 368/6 |
| 5,194,861 | 3/1993 | St. Clair | 340/870.28 |

*Primary Examiner*—Thomas G. Black
*Assistant Examiner*—Michael Zanelli
*Attorney, Agent, or Firm*—John H. Crozier

[57] ABSTRACT

In a preferred embodiment, one or more timing stations disposed around a racecar track. At each station, a timing signal in the form of a repeating or oscillating beam of laser light causes a photodetector mounted on a racecar to turn on and off, the photodetector outputting a stream of electrical pulses. A microprocessor associated with the photodetector receives the stream of pulses, determines the real time when the signal is received, and stores that real time. When the microprocessor receives an RF polling signal, unique to that racecar, from a base station, the microprocessor transmits the real time data to the base station. When a second timing signal is received from the same or a second timing station, a second real time is determined, stored, and transmitted to the base station. The base station then computes the difference between the two real times. The base station processes data from all racecars in a race by sequentially polling the racecars. Different pulse rates are employed at different timing stations and recognized by the microprocessors so that lap time, total time, time through corners, and time in pit stops can be determined for each racecar. In a further embodiment, there is provided an on-board track condition display responsive to signals transmitted from the base station to the racecars.

25 Claims, 8 Drawing Sheets

RACECAR TIMING AND TRACK CONDITION ALERT SYSTEM AND METHOD

This is a continuation-in-part of co-pending application Ser. No. 07/573,912 filed on Aug. 28, 1990, now abandoned.

BACKGROUND OF THE INVENTION

1. Field of the Invention

The present invention relates to the timing of racecars generally and, more particularly, to a novel system for timing racecars which is automatic and eliminates the need for manually operated mechanical devices and for giving racecars drivers automatic and on-board indication of racetrack conditions.

2. Background Art

From its beginnings in the late 1800's automobile racing has become a popular participant and spectator sport, flourishing in all major western nations of the world, drawing huge spectator crowds, and stimulating large financial investment by automobile manufacturers. Formal automobile race courses or tracks range from small dirt surface tracks to those which are paved and may be three to four miles to the lap. Total distances raced on the later may range from 150 to 400 miles.

The winner of such a race, of course, is the driver who completes the total distance in the least amount of time. Conventionally, such time is determined by manually operated stopwatches or similar mechanical devices, with one stopwatch required for each car. This system has the advantage of low cost but has the disadvantage of necessitating recruiting perhaps a relatively large number of people in one place, but also has the further disadvantage of introducing human error into the timing process. Also, backup personnel are required to assist the timers in identifying the cars that pass the start/finish line. The manual method is further complicated in that timing may be suspended when there is an accident or hazardous situation present on the track. The processing of the data takes a great deal of time and, consequently, the complete results of a race may be delay for hours. The manual method also makes difficult the recording of times through corners and times in pit stops.

One non-manual system that is used for racecar timing includes computerized racecars that are equipped with magnetic sensors attached beneath the cars, which sensors are responsive to magnetic stripes affixed to the track. This system is relatively expensive to install and is not particularly satisfactory, in that the magnetic stripes are very susceptible to damage, due to the racecars driving over them.

In addition to determining the total time for each car, other time intervals are of interest. These include: determining the time for each car to traverse each lap, determining the time a car stops in a pit for service, and determining the time for each car to traverse a corner. Each additional such input requires additional human effort with the concomitant multiplying of opportunities for human error.

As part of the procedure for conducting a race, signal flags are used to indicate track conditions to the racecar drivers. For example, the display of a green flag signals to the drivers that track conditions are clear. A yellow flag indicates an accident ahead. A red flag signals the drivers to stop immediately. A major disadvantage of such a procedure is that communications must be accurately made with those persons manning the flag stations so that the proper flags are displayed in the proper locations. A serious disadvantage si that they may be delay in displaying the proper flags and/or delay in the drivers seeing the flags.

Accordingly, it is a principal object of the present invention to provide a system and method for automobile racecar timing that is automatic and requires no human operations.

It is another object of the invention to provide such a system and method that is highly accurate.

It is a further object of the invention to provide such a system and method that can be used to determine the time a racecar takes to traverse each lap or part of a lap, to determine the time a racecar takes to traverse each corner, and the time a racecar is stopped in a pit.

It is an additional object of the invention to provide such a system and method that is economical and easily retrofitted to existing racetracks and racecars.

It is yet another object of the invention to provide means by which elements of the racecar timing system and method can be employed to give racecar drivers automatic and on-board indication of track conditions.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, one or more timing stations disposed around a racecar track. At each station, a timing signal in the form of a repeating or oscillating beam of laser light causes a photodetector mounted on a racecar to turn on and off, the photodetector outputting a stream of electrical pulses. A microprocessor associated with the photodetector receives the stream of pulses, determines the real time when the signal is received, and stores that real time. When the microprocessor receives an RF polling signal, unique to that racecar, from a base station, the microprocessor transmits the real time data to the base station. When a second timing signal is received from the same or a second timing station, a second real time is determined, stored, and transmitted to the base station. The base station then computes the difference between the two real times. The base station processes data from all racecars in a race by sequentially polling the racecars. Different pulse rates are employed at different timing stations and recognized by the microprocessor so that lap time, total time, time through corners, and time in pit stops can be determined for each racecar.

In a further embodiment, there is provided an on-board track condition display responsive to signals transmitted from the base station to the racecars.

BRIEF DESCRIPTION OF THE DRAWING

Understanding of the present invention and the various aspects thereof will be facilitated by reference to the accompanying drawing figures, in which.

DETAILED DESCRIPTION OF THE PREFERRED EMBODIMENTS

Figure 1:
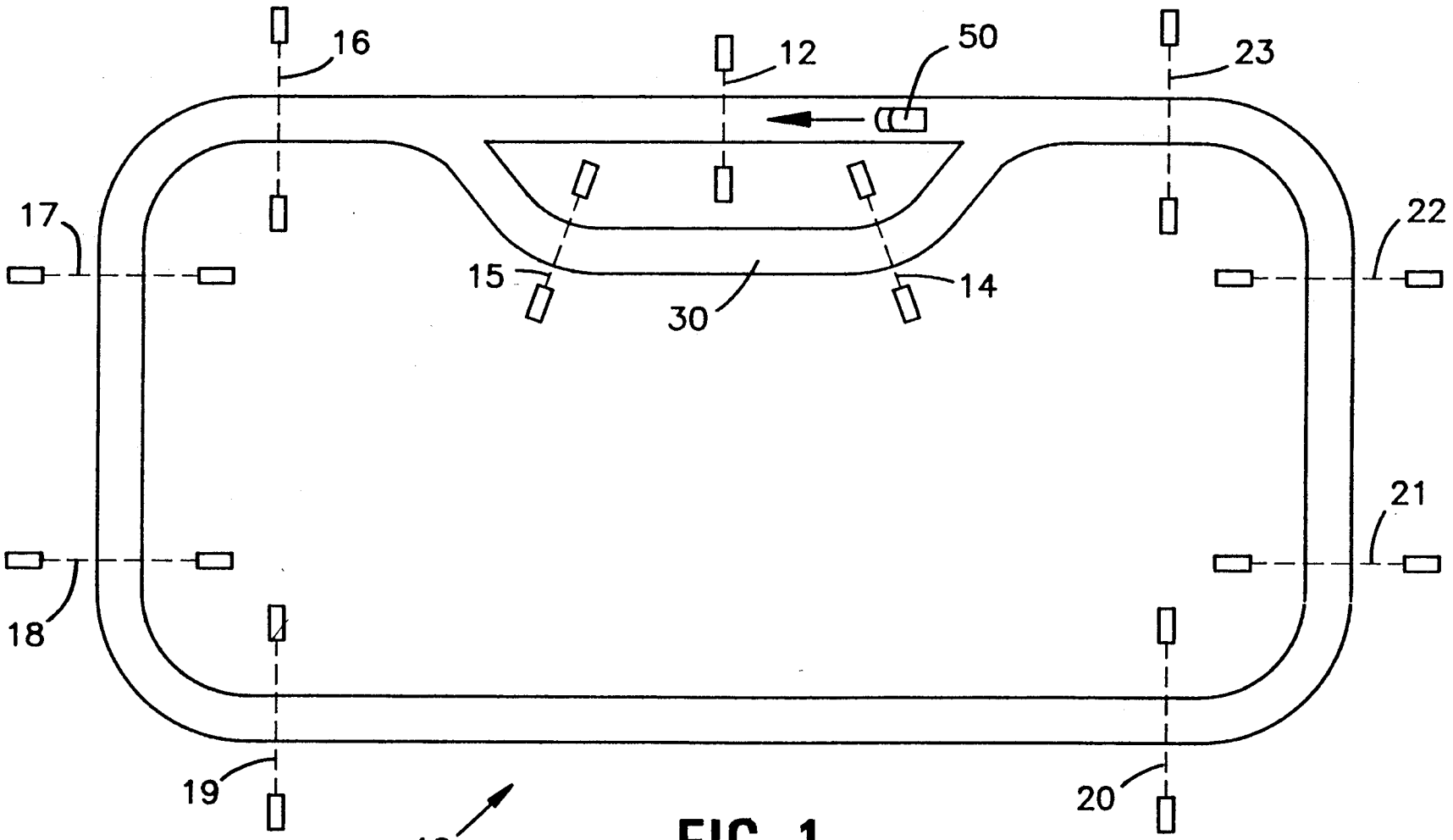
FIG. 1 is a top plan view of a automobile racetrack employing the present invention including a plurality of timing stations.

Referring now to the Drawing, in which similar or identical elements are given consistent identifying numerals throughout the various figures thereof, FIG. 1 illustrates a racetrack, generally indicated by the reference numeral 10, which employs some elements of the present invention, namely, timing stations 12, and 14–23, the details of which will be described later.

Timing station 12 is located so as to provide timing signals for the determination of lap time for each racecar, such as racecar 50. Timing station pair 14/15 is located so as to determine the time a racecar is in pit 30, with station 14 providing a timing signal when a racecar enters the pit and station 15 providing a timing signal when the racecar leaves the pit. Similarly, timing station pairs 16/17, 18/19, 20/21, and 22/23 are located so as to provide timing signals in and out of the four corners of track 10, with, for example, station 16 providing a timing signal as a racecar enters the upper lefthand corner of the track and station 17 providing a timing signal as the racecar leaves that corner.

Figure 2:
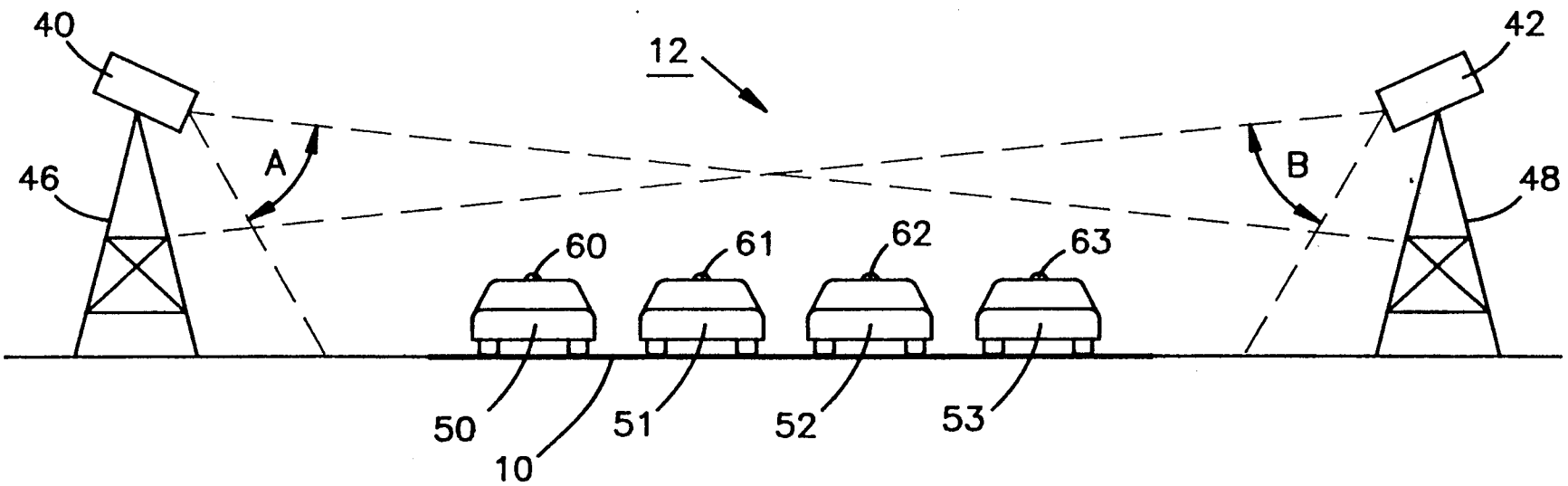
FIG. 2 is a rear elevational view of one of the timing stations of FIG. 1 with racecars passing therethrough.

Referring now to FIG. 2, the operation of timing station 12 is illustrated. Timing station 12 includes laser scanner 40 mounted on a support 44, the scanner being disposed so as to sweep a beam of laser light, which may be visible light or in some other frequency range, across track 10 through an angle "A" in a plane orthogonal to the major axis of the track, with the laser light falling on a row of racecars 50, 51, 52, and 53 shown side by side for illustrative purposes. Preferably, a second laser scanner 42 mounted on a support 48 is disposed so as to sweep a second beam of laser light across track 10 through an angle "B" in the same plane as the laser light from scanner 40, but from a direction opposite from that of the laser light from scanner 40. The purpose of providing two scanners 40 and 44 will be discussed later.

Racecars 50–53 have disposed on the roofs thereof optical receivers 60, 61, 62, and 63, respectively. It will be understood that as racecars 50–53 pass through timing station 12, the light beams from laser scanners 40 and 42 will fall on optical receivers 60–63.

Figure 3:
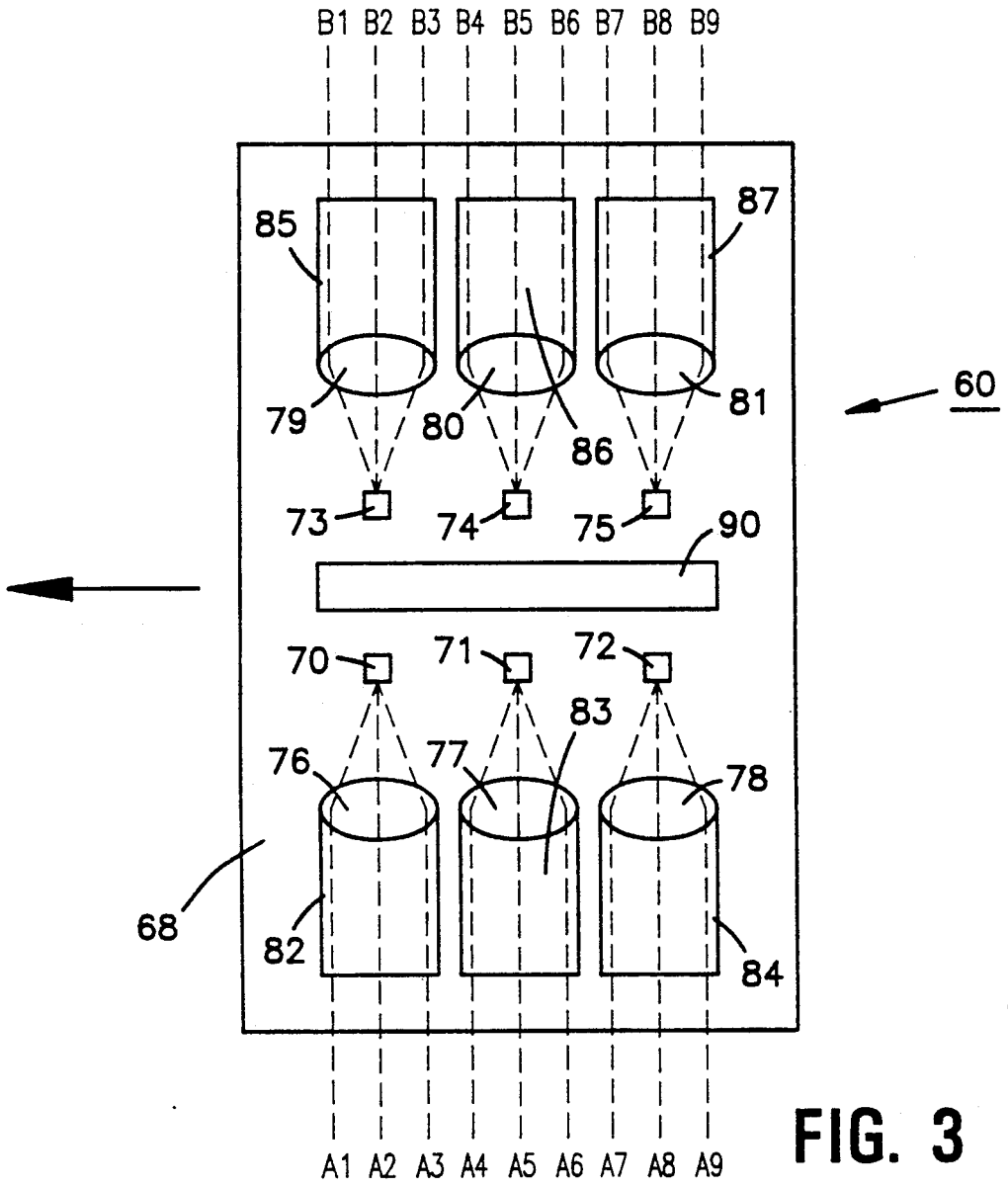
FIG. 3 is a top plan view of a timing signal receiver according to the present invention.
Figure 4:
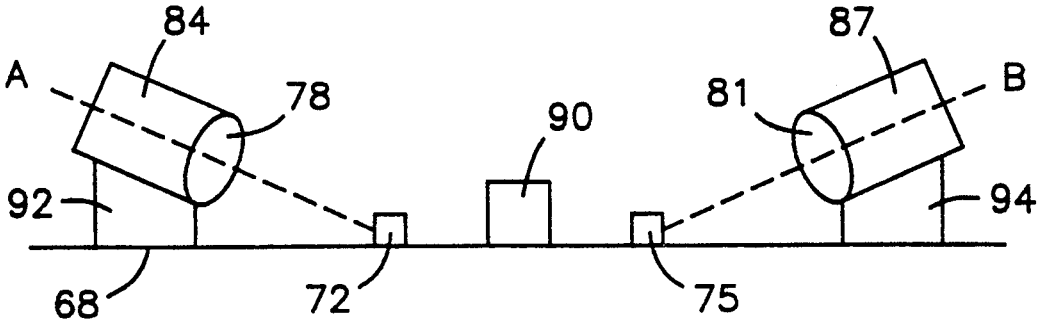
FIG. 4 is a side elevational view of the timing signal receiver of FIG. 3.

Referring now to FIGS. 3 and 4, there is illustrated the construction of the optical receivers, here, for example, optical receiver 60. Optical receiver 60 includes a base member 68 on which are mounted photodetectors 70–75 which receive, respectively, laser light focussed by lenses 76–81. Lenses 76–81 have associated light tunnels 82–87, respectively, disposed so as to conduct laser light to the lenses and so as to minimize the effect of sunlight and stray light. It will be understood that base member 68 is mounted to the roof of a racecar (not shown) and that the racecar is moving in the direction of the arrow on FIG. 3. So positioned, photodetectors 70–72 will receive laser light from, for example, laser scanner 40 (FIG. 2). Since laser scanner 40 is providing a repeating or oscillating beam of light, photodetectors 70–72 will be turned on by a series of light beams, here indicated by "A1"–"A9". Likewise, photodetectors 73–75, which are aligned in a bank side by side with the bank of photodetectors 70–72, will receive light beams "B1"–"B9" from laser scanner 42 as the racecar passes through timing station 12. The number of such light beams received at any given timing station will depend on the rate of oscillation and the speed of the racecar. For example, with a laser scanner outputting a scan at the rate of 2OOO sweeps per second, a 10-inch long bank of photodetectors will receive about 5 pulses at a timing station when the racecar is traveling 240 mph.

It will be seen from FIG. 4 that the light tunnels and lenses, here light tunnel/lens pairs 84/78 and 8/81 are mounted on supports 92 and 94, respectively, at an angle to the plane of base member 68 so that the light tunnel/lens pairs are aligned generally with the beams of light from laser scanners 40 and 42.

Also mounted on base member 68 is a package of electronic circuitry 90 the function of which will be described later.

It will be understood that optical receiver 60 may be fitted with a suitable cover member (not shown).

Referring again to FIG. 1, in order to distinguish between various timing stations, a different sweep rate is employed depending on the type of timing station. For example, the 2000 sps (sweeps per second) rate may be chosen for timing station 12. Since racecars reduce speed for corners, a sweep rate of 1000 sps can be used at timing stations at corners, such as timing stations 16/17, and, since racecars have greatly reduced speed when entering or leaving a pit, a sweep rate of 500 sps can be used at timing stations 14/15 at pit 30.

Figure 6:
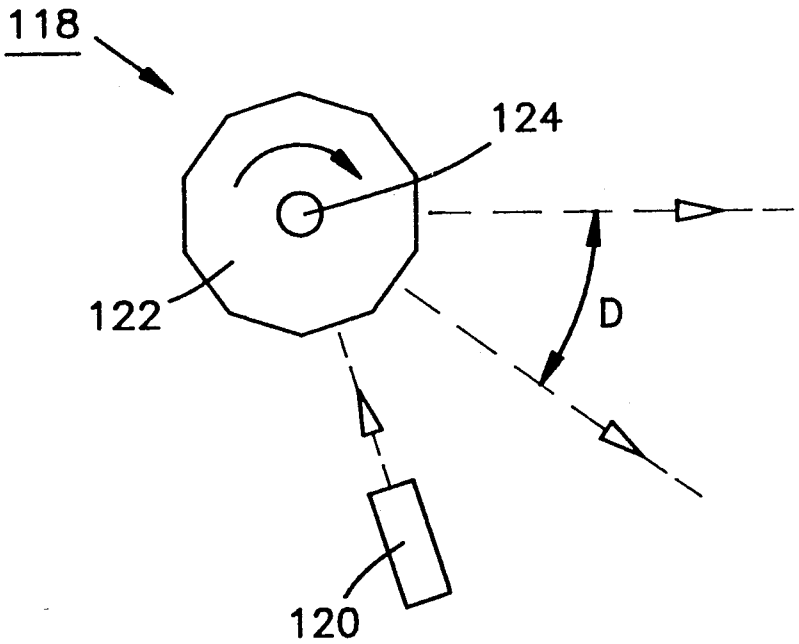
FIG. 6 is a side elevational view of another embodiment of a timing scanner according to the present invention.
Figure 5:
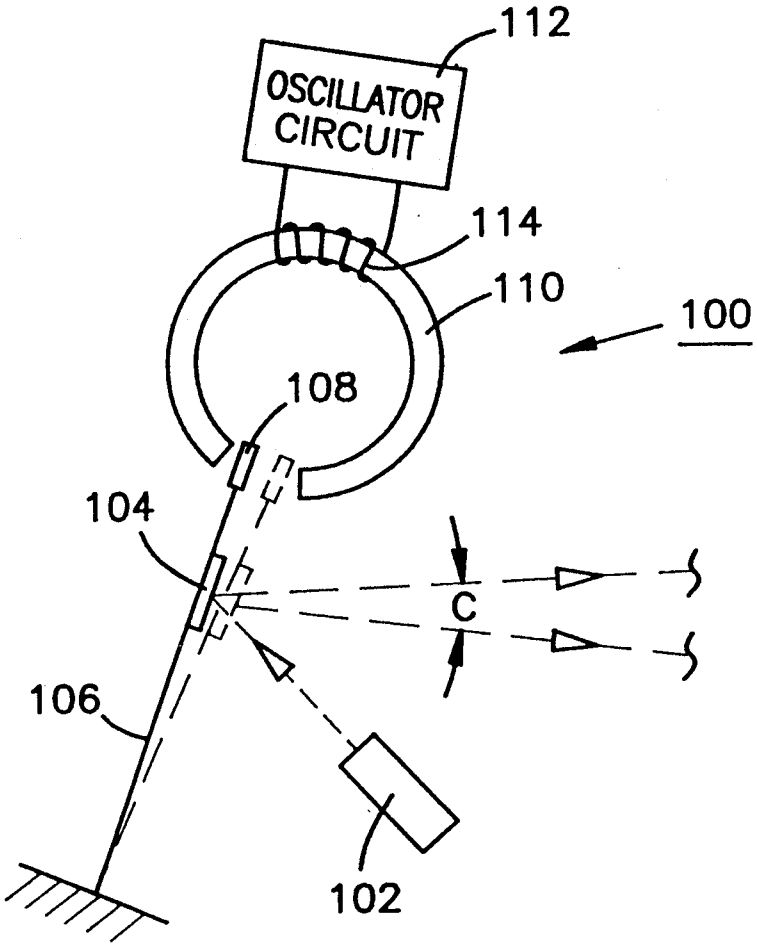
FIG. 5 is a side elevational view of one embodiment of a timing scanner according to the present invention.

FIGS. 5 and 6 illustrate embodiments of laser scanners which may be employed to provide the sweeping laser beams across racetrack 10 and one or the other types of which, it will be understood, would be mounted in laser scanners 40 and 42 (FIG. 2). In FIG. 5, a laser scanner, generally indicated by the reference numeral 100, includes a laser 102 disposed so as to provide laser light to be reflected by a mirror 104 which is mounted on a vibrating reed 106. Mounted at the distal end of reed 106 is a ferromagnetic armature 108 which is disposed within a gap formed in a field electromagnet 110. Flux flow within field electromagnet 110 is caused to oscillate by alternating current from an oscillator circuit 112 supplied to coil 114, thus, in turn, causing armature 108 and vibrating reed 106 to alternatingly move between the positions shown in solid lines and in broken lines on FIG. 5. This oscillation motion causes the light beam to be reflected through an angle "C." This angle is determined by the amplitude of the oscillation circuit. Since the light beam reflected by mirror 104 sweeps both up and down as reed 106 vibrates, a 1000 Hz. AC current will provide 2000 sps of the oscillating light beam.

In FIG. 6, a laser scanner, generally indicated by the reference numeral 118, includes a laser 120 disposed so as to provide laser light to be reflected by a polygonal mirror 122 which is mounted on a shaft 124 for rotation therewith. As polygonal mirror 122 rotates, laser light will sweep across racetrack 10 in a repeating beam through an angle "D." Angle "D" is theoretically close to 180 degrees, but the usable angle is much smaller. With polygonal mirror 122 having 10 faces as shown, a rotational speed of 12,000 rpm will produce 2000 sps.

Figure 7:
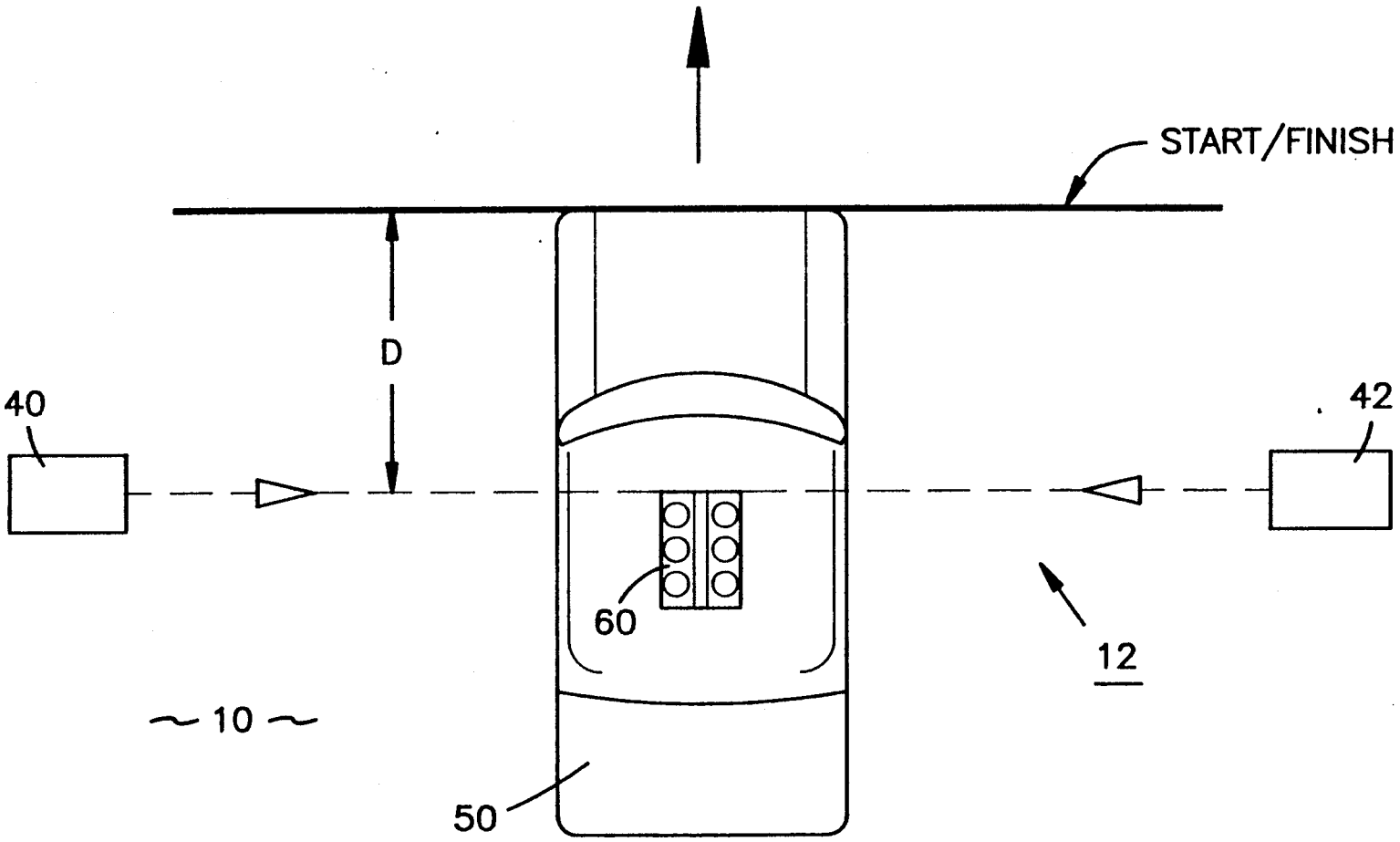

FIG. 7 illustrates the placement of optical receivers on racecars. Here, racecar 50 with optical receiver 60 mounted thereon is shown just touching the start/finish line. It can be seen that the plane of laser light swept by timing station 12 across racetrack 10 is positioned back from the start/finish line a distance "D" which is equal to the distance from the front edge of racecar 50 to the front edge of optical sensor 60, the latter point being that where the first sweep of laser light will be received by the optical sensor.

Optical sensors may be permanently attached to racecars or they may be temporarily attached by means of conventional hook and loop fabrics. Thus, the present invention may be easily retrofitted to existing racecars, it being completely self-contained and requiring no connection to the racecar's electrical system or access by the driver of the racecar.

Figure 8:
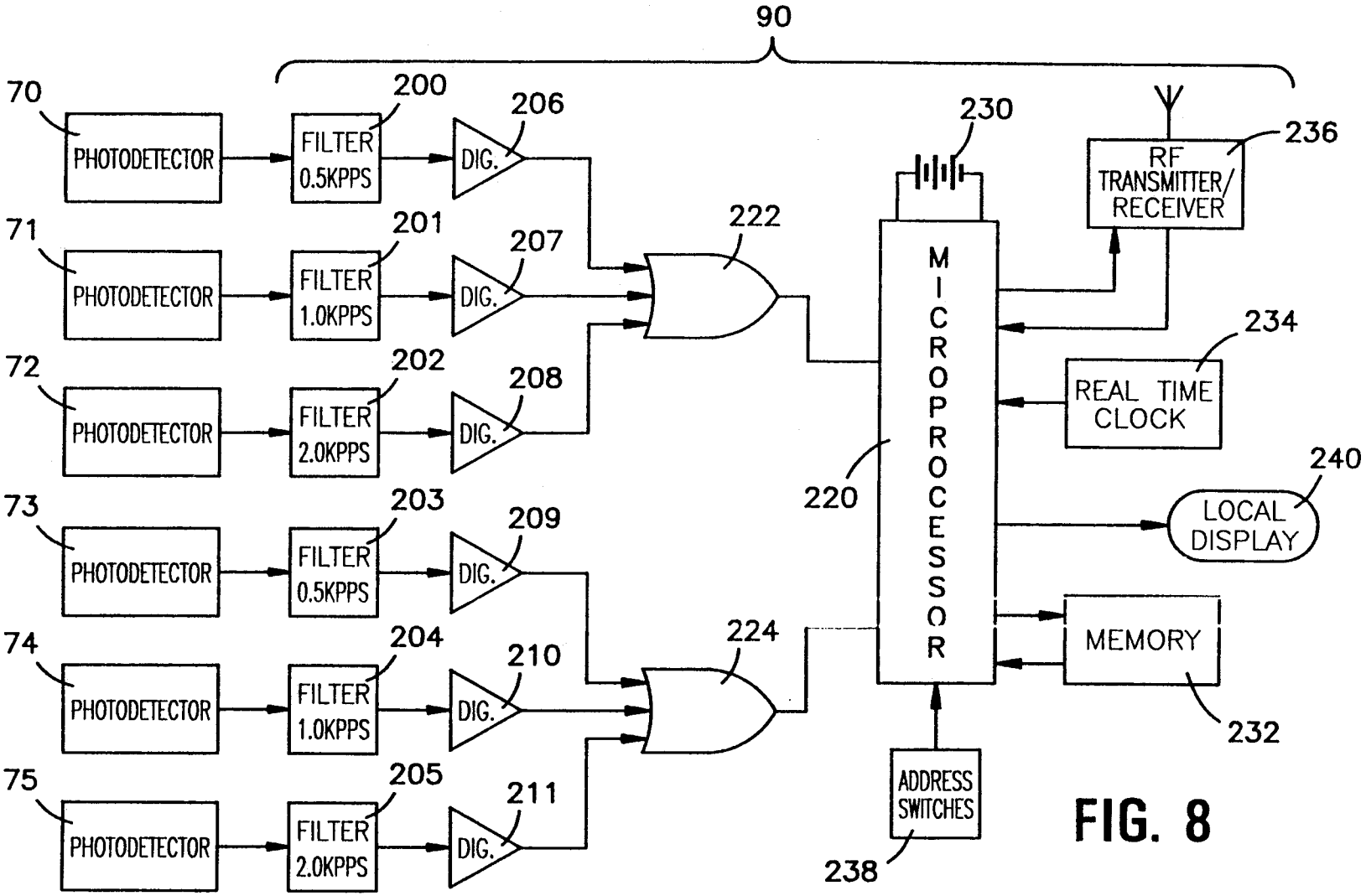
FIG. 8 is a block/schematic diagram illustrating the means by which timing signals are received and transmitted by the timing signal receiver of FIG. 3.

Referring now to FIG. 8, there is illustrated schematically the circuitry 90 by which information derived from the laser light beams is processed, assuming that the system of the present invention is employing the three pulse rates noted above. Photodetectors 70–75 receive laser light sweeps and generate electrical pulses in response thereto. It will be recalled from FIG. 3 that photodetectors 70–72 are disposed so as to receive laser light sweeps from laser scanner 40 (FIG. 2) and that photodetectors 73–75 are disposed so as to receive laser light sweeps from laser scanner 42. The electrical pulses pass, respectively, through bandpass filters 200–205 and digitizers 206–211, each bandpass filter/digitizer pair processing electrical pulses corresponding to one of the sweep rates, i.e., 0.5K sps, 1.OK sps, or 2.OK sps. The electrical pulses, i.e., 0.5K pps (pulses per second), 1.OK pps, or 2.OK pps, from the two groups of photodetectors, 70–72 and 73–75, are inputted to a microprocessor 220 through OR gates 222 and 224, respectively. Microprocessor 220 has associated therewith a battery 230, a memory 232, a real time clock 234, an RF transmitter/receiver 236, address switches 238, and a local display 240. It will be understood that all of the elements shown on FIG. 8, except local display 240, are located in optical receiver 60 mounted on racecar 50.

Figure 9:
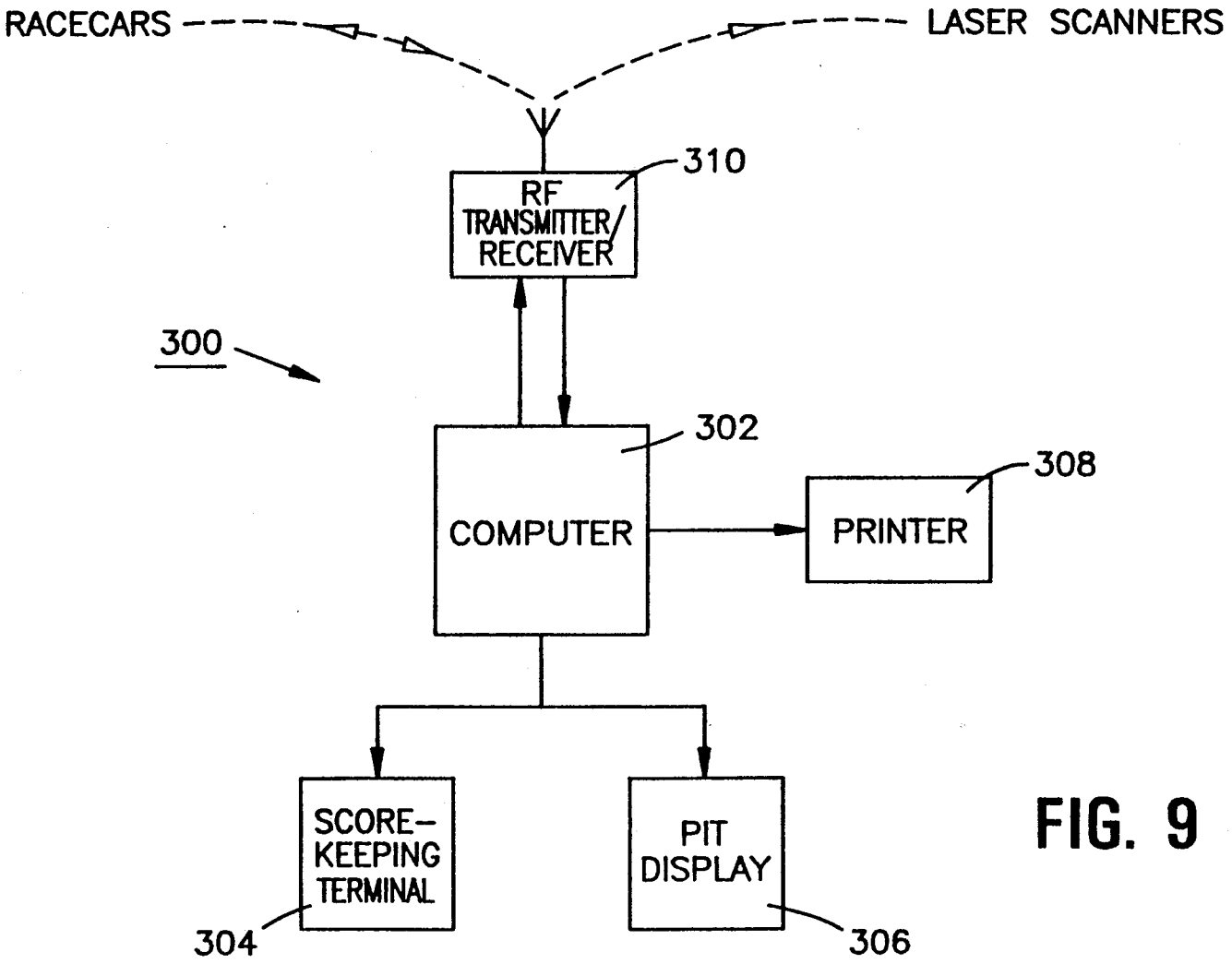
FIG. 9 is a block diagram illustrating the means by which timing signals are received and processed by a base station according to the present invention.

Completing the system of the present invention, and illustrated on FIG. 9, is a base station, generally indicated by the reference numeral 300. Base station 300 includes a central computer 302 with which is associated a score-keeping terminal 304, a pit display 306, a printer 308, and an RF receiver/transmitter 310.

With reference also now to the others figures, the operation of the timing system of the present invention will be described.

While the racecars are preparing for the start, computer 302, through RF receiver/transmitter 310, first initiates operation of the optical receivers on the racecars and initiates operation of the timing stations, also setting the desired scan rates according to instructions inputted to the computer by score-keeping personnel. Computer 302 then transmits the real time to all optical receivers and then polls each to ensure that each has correctly received the real time and set its real time clock accordingly. Thus, it can be determined that all cars are in synchronization and that the RF receivers/-transmitters are operational.

At the start, racecar 50 will cross the start/finish line (FIGS. 1 and 7) while passing through timing station 12. Photodetector 72 (FIG. 3) will receive 2.OK light sps and convert the same to 2.OK electrical pps which, after initial processing, are inputted to microprocessor 220 which measures the frequency of the detected pulses. When microprocessor 220 detects that the frequency of detected pulses is indeed 2.OK pps, the microprocessor transfers the time from its real time clock 234 to its memory 232. When microprocessor 220 receives from RF transmitter/receiver 236 a polling signal from central computer 302 (FIG. 9) through RF receiver/transmitter 310, the address of which polling signal corresponds to an address previously set on address switches 238, the real time stored in memory 232 is transmitted to the central computer 302 through RF transmitter/receivers 236 and 310 along with an indication of the frequency of the timing signal. It is of no consequence that one or more racecars may be passing timing station 12 at the same time, since all will receive the timing beam virtually simultaneously.

When racecar 50 again passes through timing station 12, the time of a second 2.OK sps signal will be stored and transmitted to central computer 302 (FIG. 9) during the next polling following the latter event. The central computer then subtracts the first time from the second time to determine the absolute time it took racecar 50 to circle racetrack 10. The foregoing process is reiterated each subsequent time racecar 50 passes through timing station 12. Central computer 302 accumulates the total time for racecar 50 and can store individual lap times if desired. Instantaneous and cumulative information can be provided the score-keeper on terminal 304 and to the pit crew on display 306 and printed immediately on printer 308 during and/or after the race.

In order to allow time for processing information and to eliminate the possibility of interference with RF transmissions from two or more racecars, central computer 302 sequentially polls the racecars. A polling rate of five cars per second is satisfactory for most racing conditions. When a car is polled, it transmits all data accumulated since the previous polling of that car.

Continuing to refer especially to FIGS. 1, 8, and 9, when racecar 50 approaches a corner, for example the upper lefthand corner of racetrack 10, it will pass through a first timing station, here, timing station 16. Photodetector 71 now will receive 1.OK sps which, in the manner described above with respect to timing station 12, will result in a first real time being stored in memory 232 and transmitted to central computer 302 at the next polling. Now, when racecar 50 passes through timing station 17, a second 1.OK sps will be received and a second real time will be stored and subsequently transmitted. Central computer 302 will then compute the difference between the two real times. Because of the order of corners passed by racecar 50 with respect to each other and to a reference such as timing station 12, it will be apparent which corner is being reported.

Still referring to FIGS. 1, 8, and 9, when racecar 14 passes through timing station 14, a 0.5K sps will be received by photodetector 70 and a first time stored and transmitted as described above. Likewise, a second 0.5K sps received at timing station 15 will result in the time in the pit stop being computed by central computer 302.

Should the race be suspended for a period of time, due to an incident on track 10, such information can be separately inputted to central computer 302 which will appropriately account for that period of time. Likewise, penalty times can be similarly inputted.

In order to allow for spurious pulses in the detecting system, microprocessor 220 (FIG. 8) is programmed to determine a time only after a given number of pulses are received. For example, microprocessor 220 can be programmed to determine a real time only after receiving a selected number of pulses at one of the frequencies employed. For example, when the first pulse is received, the computer notes the real time and then looks for two additional pulses spaced apart by the appropriate time intervals. After those pulses are received, the real time previously noted is stored. Should the parameters of racecar speed and beam scan rate so dictate, multiple photodetectors may be employed for each beam scan rate to assure that a minimum number of pulses are received at each timing station.

With two sets of photodetectors, such as photodetectors 70–72 and 73–75 (FIG. 3), facing sideways from opposite sides of racecar 50 toward laser scanners 40 and 42 FIG. 2), respectively, there are two separate sets of electrical pulse inputs to microprocessor 220. This redundancy can be used to indicated that valid light pulses are being received and also to compensate for sunlight or track lighting. In the latter situations, the one of the sets of photodetectors 70–72 or 73–75 receiving sunlight or track lighting will output a continuous electrical signal. This will result in no data input from that channel to microprocessor 220 which will then rely on the input from the other of the photodetectors.

Differential time measurements from microprocessor 220 may also be sent to a local display 240 located in racecar 50. Although the use of such displays is generally not permitted during a race, display 246 can be of assistance to a driver during practice trials.

Figure 10:
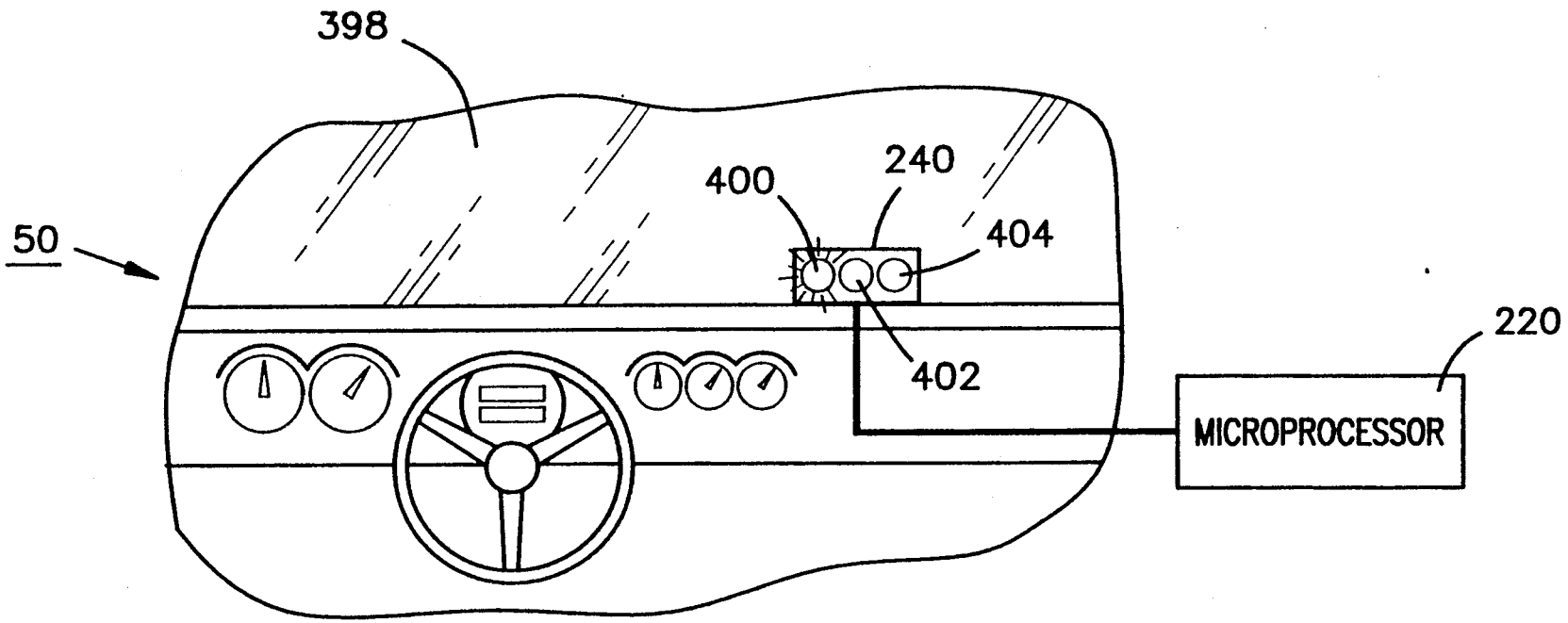
FIG. 10 is a block/schematic diagram illustrating the use of the present invention in providing on-board track condition information.

FIG. 10 illustrates how the system and method of the present invention can be employed to furnish on-board track condition information to the driver of racecar 50. Here, local display 240 connected to microprocessor 220 (See also FIG. 8.) is mounted at the lower edge of windshield 398 of racecar 50. Included in local display 240 are a green light 400 (shown lighted, indicating that conditions are clear), a yellow light 402, and a red light (404).

When a hazardous condition exists, an appropriate entry to computer 302 in base station 300 (FIG. 9) will cause RF receiver/transmitter 310 (FIG. 9) to transmit a signal to RF transmitter receiver 236 (FIG. 8) connected to microprocessor 220. Microprocessor 220 will activate local display 240 to extinguish green light 400 and to light yellow light 402, thus alerting the driver of racecar 50 that a hazardous condition exists ahead. Because the locations of all racecars are known, due to the timing signals received from timing stations 12–23, only those racecars approaching the hazard will receive the hazardous condition signal. For example, if a hazardous condition exists at the lower right hand corner of track 10 (FIG. 1), racecar 50 would receive the hazardous condition signal once it passed timing station 19 and the hazardous condition signal would be removed once that racecar passed timing station 21. Thus, once the hazardous location is entered into computer 302, all racecars receive the hazard warning automatically, but only as they approach the hazard. The location of local display 240 ensures that the driver of racecar 50 will immediately be alerted to the track conditions prior to approaching the flags stations. Thus, use of the present invention greatly improves the safety of racecar driving.

Should it be necessary to stop all racecars, the "red" stop signal would be transmitted to all racecars simultaneously.

While only the three most critical lights are shown in local display 240, it will be understood that additional lights, corresponding to other signal flags, may also be included in local display 240.

It is within the intent of the present invention that some of the computing functions performed by central computer 302 (FIG. 9) may also be performed by microprocessor 220 (FIG. 8).

It will be understood that the system of the present invention can easily be retrofitted to existing racetracks and racecars and can be made portable. The system is constructed of highly reliable components and a minimum number of manual inputs is required.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A timing system for at least a first racecar moving along a racetrack, comprising:

(a) a first timing station, disposed at a selected site on said racetrack, to provide a first timing signal to be received by said first racecar when said first racecar passes said first timing station, said timing signal comprising a light beam repeatedly sweeping across said racetrack, horizontally and vertically, in a plane orthogonal to the major axis of said racetrack, so as to produce a sheet of light orthogonal to said major axis of said racetrack such that two or more side-by-side racecars can virtually simultaneously receive said light beam; and (b) receiving means disposed on said first racecar to receive said first timing signal and to provide an output indicative thereof, said receiving means being vertically disposed below the origin of said light beam.

2. A timing system, as defined in claim 1, wherein a second timing signal is received when said first racecar next passes said first timing station.

3. A timing system, as defined in claim 1, further comprising: first processing means to receive said output of said receiving means and to store in a memory the real time of receipt of said first timing signal.

4. A timing system, as defined in claim 3, further comprising: transmitting means connected to said first processing means to transmit to a central computing means said real time of receipt of said first timing signal, in response to a polling signal from said central computing means.

5. A timing system, as defined in claim 4, wherein said computing means sequentially polls said first processing means and at least a second processing means in at least a second racecar.

6. A timing system, as defined in claim 3, wherein a second timing signal is produced by a second timing station spaced apart from said first timing station along said racetrack and said second timing signal is received by said receiving means when said first racecar passes said second timing station.

7. A timing system, as defined in claim 6, wherein:

(a) said first and second timing signals are produced at a first selected frequency;

(b) said timing system comprises third and fourth timing stations disposed in spaced apart relationship along said racetrack;

(c) said third and fourth timing stations produce timing signals at a second selected frequency to be received by said first racecar; and (d) said receiving and processing means differentiate between said first and second and said third and fourth timing signals to determine the respective identities of the sources thereof.

8. A timing system, as defined in claim 3, further comprising display means disposed in said first racecar and connected to said first processing means to display information indicative of said time interval.

9. A timing system, as defined in claim 1, wherein said light beam is light reflected from a rotating polygonal mirror.

10. A timing system, as defined in claim 1, wherein said light beam is light reflected from an oscillating mirror.

11. A timing system, as defined in claim 1, wherein said light is produced by a laser.

12. A timing system, as defined in claim 1, wherein said first timing station is remotely controlled by said central computing means.

13. A timing system, as defined in claim 1, wherein said receiving means is mounted to an upper surface of said first racecar.

14. A timing system, as defined in claim 1, further comprising indicating means disposed in said first racecar and in at least a second racecar to indicate track conditions, said indicating means in said first and at least a second racecar to be selectively activated in response to a track condition signal received by said receiving means, so that either or both said indicating means in said first and at least said second racecar can be activated to indicate track conditions.

15. A timing system, as defined in claim 14, said indicating means including green, yellow, and red lights.

16. A timing system, as defined in claim 14, wherein said track condition signal is automatically received by said receiving means after said first and/or at least a second racecar passes said first timing station.

17. A method of timing a first racecar moving along a racetrack, comprising the steps of:

(a) providing a first timing station, disposed at a selected site on said racetrack, to provide a first timing signal to be received by said first racecar when said first racecar passes said first timing station, said first timing signal comprising a light beam repeatedly sweeping across said racetrack, horizontally and vertically, in a plane orthogonal to the major axis of said racetrack, so as to produce a sheet of light orthogonal to said major axis of said racetrack such that two or more side-by-side racecars can virtually simultaneously receive said light beam; and (b) receiving, at said first racecar at a vertical position below the origin of said light beam, said first timing signal and providing an output indicative thereof and receiving, at said first racecar, a subsequent, second timing signal from a timing station; and (c) determining the times when said first and second timing signals are received; and (d) determining the time interval between said first and second timing signals.

18. A method, as defined in claim 17, further comprising the step of storing in a memory the time said first timing signal is received and transmitting to a central computing means the time when said first timing signal is received, in response to a polling signal from said central computing means.

19. A method, as defined in claim 18, further comprising the step of said central computing means sequentially polling said first racecar and at least one other racecar.

20. A method, as defined in claim 18, further comprising the step of remotely controlling said first timing station by said central computing means.

21. A method, as defined in claim 17, further comprising the step of receiving said second timing signal when said first racecar next passes said first timing station.

22. A method, as defined in claim 17, further comprising the step of producing said second timing signal by a second timing station spaced apart from said first timing station along said racetrack and receiving, at said first racecar, said second timing signal when said first racecar passes said second timing station.

23. A method, as defined in claim 22, further comprising the step of:

(a) producing said first and second timing signals at a first selected frequency;

(b) producing third and fourth timing signals at third and fourth timing stations, respectively, disposed in spaced apart relationship along said racetrack;

(c) producing said third and fourth timing signals at a second selected frequency to be received by said first racecar; and (d) differentiating between said first and second and said third and fourth timing signals to determine the locations of the respective sources thereof.

24. A method, as defined in claim 17, further comprising the step of displaying in said first racecar information indicative of said time interval.

25. A method, as defined in claim 17, further comprising the step of mounting to an upper surface of said first racecar receiving means to receive said first timing signal.

* * * * *